US007658570B2

(12) United States Patent
Hill et al.

(10) Patent No.: US 7,658,570 B2
(45) Date of Patent: Feb. 9, 2010

(54) MANHOLE SYSTEM

(75) Inventors: Simon Christopher Hill, Liberty, MO (US); David Stewart Miller, Kansas City, MO (US)

(73) Assignee: Delaware Captial Formation, Inc., Wilmington, DE (US)

( * ) Notice: Subject to any disclaimer, the term of this patent is extended or adjusted under 35 U.S.C. 154(b) by 0 days.

(21) Appl. No.: 11/542,328

(22) Filed: Oct. 2, 2006

(65) Prior Publication Data

US 2008/0078127 A1 Apr. 3, 2008

(51) Int. Cl.
*B65D 43/18* (2006.01)

(52) U.S. Cl. ..... 404/25; 220/232; 220/823

(58) Field of Classification Search ..... 404/25; 52/20, 19; 220/232, 823
See application file for complete search history.

(56) References Cited

U.S. PATENT DOCUMENTS

| | | | | | |
|---|---|---|---|---|---|
| 1,234,133 | A | | 7/1917 | Cole | |
| 1,314,306 | A | * | 8/1919 | Cullison | 220/86.2 |
| 1,494,745 | A | | 5/1924 | Griffin et al. | |
| 1,669,022 | A | | 5/1928 | Root, Jr. | |
| 1,683,823 | A | | 9/1928 | Heil | |
| 1,685,132 | A | | 9/1928 | Joy | |
| 1,870,973 | A | | 8/1932 | Thwaits | |
| 1,883,880 | A | | 10/1932 | Cole | |
| 1,889,606 | A | | 11/1932 | Lange | |
| 1,896,330 | A | | 2/1933 | Ruppel | |
| 1,929,761 | A | | 10/1933 | Thwaits | |
| 2,120,961 | A | * | 6/1938 | Beede | 220/263 |
| 2,420,411 | A | | 5/1947 | Blount, Sr. | |
| 3,151,903 | A | | 10/1964 | Effner | |
| 3,262,227 | A | * | 7/1966 | Pentecost | 49/354 |
| 3,339,785 | A | | 9/1967 | Nugent | |
| 3,352,446 | A | | 11/1967 | Anderson et al. | |
| 3,360,155 | A | | 12/1967 | Colonna | |
| 3,476,042 | A | * | 11/1969 | Dugge et al. | 105/377.06 |
| 3,500,584 | A | | 3/1970 | Clery et al. | |
| 3,595,530 | A | * | 7/1971 | Hubers | 366/332 |
| 3,666,135 | A | * | 5/1972 | Kindle | 220/816 |
| 3,694,962 | A | | 10/1972 | McDonald et al | |
| 3,860,142 | A | | 1/1975 | Jurges | |
| 3,911,972 | A | * | 10/1975 | Hubers et al. | 141/7 |
| 4,044,918 | A | * | 8/1977 | Alton | 220/314 |
| 4,196,231 | A | * | 4/1980 | Hubers | 427/240 |

(Continued)

FOREIGN PATENT DOCUMENTS

DE 19860401 A1 6/2000

(Continued)

*Primary Examiner*—Gary S Hartmann
(74) *Attorney, Agent, or Firm*—Seyfarth Shaw LLP

(57) ABSTRACT

A remotely actuated manhole system is disclosed having a cover that is pivotable relative to a frame secured with a collar on a bulk carrier, the cover being pivotable around a substantially vertical axis between and to open and closed positions. In the closed position covering an opening to a compartment in the bulk carrier, the cover is shiftable vertically between and to locked and unlocked positions by an inflatable seal member below the cover. The manhole system includes catches that prevent over-rotation of the cover from the open position to the closed position, and the catches engage in the locked position by the vertical upward movement of the cover. The inflation of the seal member and the pivoting of the cover are remotely actuated.

17 Claims, 8 Drawing Sheets

U.S. PATENT DOCUMENTS

| | | | | |
|---|---|---|---|---|
| 4,294,378 | A | 10/1981 | Rabinovich | |
| 4,441,431 | A | 4/1984 | Carney, Jr. et al. | |
| 4,461,597 | A | 7/1984 | Laurin | |
| 4,501,377 | A | 2/1985 | Palmer, III | |
| 4,854,076 | A * | 8/1989 | Sieben et al. | 49/280 |
| 5,105,966 | A | 4/1992 | Fort et al. | |
| 5,366,317 | A * | 11/1994 | Solimar | 404/25 |
| 5,657,892 | A * | 8/1997 | Bolli et al. | 220/325 |
| 5,918,756 | A * | 7/1999 | Morgan | 220/263 |
| 5,937,581 | A | 8/1999 | Matye et al. | |
| 6,053,348 | A * | 4/2000 | Morch | 220/263 |
| 6,076,471 | A | 6/2000 | Burian et al. | |
| 6,095,365 | A * | 8/2000 | Yielding | 220/264 |
| 6,105,805 | A | 8/2000 | Labelle et al. | |
| 6,196,590 | B1 * | 3/2001 | Kim | 280/830 |
| 6,293,051 | B1 | 9/2001 | Matye | |
| 6,318,402 | B1 * | 11/2001 | Ladeira | 137/240 |
| 6,352,036 | B1 | 3/2002 | Early | |
| 6,427,384 | B1 * | 8/2002 | Davis, Jr. | 49/255 |
| 6,561,373 | B1 | 5/2003 | Chapin | |
| 6,884,325 | B1 * | 4/2005 | Mabry et al. | 202/242 |
| 6,902,082 | B2 * | 6/2005 | Mabry et al. | 220/816 |
| 6,952,996 | B2 | 10/2005 | Sisk et al. | |
| 7,341,398 | B2 * | 3/2008 | Johnson et al. | 404/25 |
| 2002/0190068 | A1 * | 12/2002 | Sisk et al. | 220/263 |
| 2005/0166458 | A1 * | 8/2005 | McKenzie et al. | 49/394 |

FOREIGN PATENT DOCUMENTS

| | | |
|---|---|---|
| GB | 1403444 | 8/1975 |
| GB | 1452583 | 10/1976 |
| GB | 2206917 A | 1/1989 |
| JP | 11139383 A2 | 5/1999 |

* cited by examiner

MANHOLE SYSTEM

FIELD OF THE INVENTION

The invention relates to closure systems and, in particular, to a manhole system for a bulk carrier such as a tank and, more particularly, to a manhole system with a manhole cover positionable over an opening in a bulk carrier and shiftable to lock the manhole cover.

BACKGROUND

A bulk carrier, or bulk material carrier, refers to a variety of devices that permit transport and/or storage of bulk material. Therefore, and by way of example, the term bulk carrier encompasses both stationary and vehicular vessels including tank-type vehicles, such as trucks or truck trailers, railway cars, such as hopper and tank-type cars, barges and the like, and may be used for bulk ladings such as liquids, food grains, and pelletized materials, to name a few. The bulk carrier often is designed to have a closable compartment in which the bulk material is received and stored, the compartment often times being sealed and possibly pressurized.

The bulk carrier typically is designed with a manhole system permitting access to the closable compartment. It should be noted that a variety of structures may be provided for the bulk material to be introduced into and/or removed from the compartment other than a manhole system. However, the manhole system allows a person to physically enter the closable compartment, such as may be required for inspecting or cleaning the compartment interior. The manhole system, nonetheless, allows bulk material to be filled into or drawn out of the compartment.

The common industry practice is for a bulk carrier to be positioned to allow an input or output apparatus to align with the manhole system. The manhole system is opened, most often by a person climbing onto the bulk carrier and manually opening the manhole cover itself by moving it from a closed position over the opening to an open position substantially away from the opening, whereupon the input or output apparatus is positioned proximate to or within the opening for introducing bulk material to, or removing bulk material from, the compartment.

For a number of reasons, it has become desirable to have the opening and closing of the manhole cover be done by remote actuation. This obviates the need for a person to climb onto the bulk carrier, and makes the opening/closing a faster operation. However, these powered systems have brought to light a new set of issues. One such issue is that, without being able to see the manhole system located on a top surface of the bulk carrier, an operator may have difficulty recognizing the exact position of the manhole cover over the opening and cannot inspect the system prior to closing to make sure it is clear of errant bulk material or other debris.

Another issue for these powered systems is the size of the manhole or cover itself. In some manhole designs, the manhole cover shifts in a straight line along a longitudinal direction of the bulk carrier away from the opening. Such a system may utilize a piston for shifting the manhole cover in one direction, which necessitates the piston being at least greater than the size of the manhole cover itself, as well as a rail system for supporting the manhole cover as it moves away from the opening. This leads to a large and possibly expensive system, and the rails may have to be precisely positioned along the top of the bulk carrier which itself may be a rounded tank surface. This makes it difficult to retrofit or install the manhole system on a bulk carrier.

Another manhole system has the cover pivot upwardly. As the manhole cover is relatively large and made of metal, its weight requires a large piston in order to accommodate the large torque required to lift the manhole cover. Furthermore, the manhole cover in an upright position is an obstruction to equipment used for loading and unloading the bulk material from the carrier.

A manhole system shown in U.S. Pat. No. 6,053,348, to Morch, shows a manhole cover that is pivoted around a substantially vertical axis. This system utilizes an actuating mechanism positioned between the axis and opening so that a relatively short piston may be used to shift the manhole cover between open and closed positions. However, the manhole system of the '348 patent still suffers from a number of deficiencies. For instance, an operator of the manhole system of the '348 patent is still unable to determine the exact position of the manhole cover.

Of greater concern is the locking of the manhole cover. It is common for manhole systems to have braces or catches to assist in locking the manhole cover in the closed position. One or more catches are mounted with a stationary portion of the system or with the bulk carrier itself, such as an upstanding annular lip formed on the bulk carrier, and one or more catches are also provided on the manhole cover. When the manhole cover is moved to the closed position, the stationary catches engage with the manhole cover, and the manhole cover catches engage with the stationary portion of the system or the bulk carrier.

In non-powered manhole systems, the operator would manually shift the catches between locked and unlocked positions. With the powered systems, the catches have but a single position. As the catches need to permit the manhole cover to shift between the open and closed positions, their effectiveness in securing with the manhole cover is less than desirable. The use of an inflatable seal between the manhole cover and the opening frame closes any space therebetween, but does not help in locking the hatch because support structures provided for permitting movement by the manhole cover, such as the rails or a pivot pin forming the pivot axis, do not allow any other type of movement of the manhole cover relative to the catches. To the extent such other type of movement occurs, it may have deleterious effects on the support structures, such as bending of the pivot pin.

Accordingly, there has been a need for an improved remotely-actuated manhole system.

SUMMARY

In accordance with an aspect of the present invention, a manhole system is disclosed having a cover that is positionable in a closed position over an opening in a compartment of a bulk carrier and is positionable in an open position away from the opening, and having a seal member that shifts the cover in the closed position from an unlocked position to a locked position. In this manner, the cover is shiftable to engage catches for securing the cover in the locked position. Preferably, both the cover and a stationary portion includes catches. The stationary portion may be a portion of the bulk carrier, may be a collar secured around the opening and with the bulk carrier, or may be a frame secured to the collar. The catches also serve to prevent movement of the cover beyond the closed position.

Preferably, the seal member has an inflated configuration providing both a seal and the locking movement of the cover. The seal member may be carried on a bottom side of the cover, or, less preferably, may be carried on the manhole system frame. The weight of the cover may be utilized to assist in deflating the seal member and acts to gravitationally shift the cover downwardly from the locked position to the unlocked position.

Preferably, the manhole system includes a pivot pin around which the cover rotates. The pivot pin provides a substantially vertical axis and is sized to permit the cover to shift vertically between the locked and unlocked positions.

The manhole system is remotely actuated and controlled by an operator. Accordingly, the cover is pivoted to and between the open and closed positions by a remotely actuated mechanism, preferably a powered mechanism such as a piston utilizing fluid or air pressure. The piston may be retractable to move the cover to the closed position and extendable to move the cover to the open position. In a preferred form, the piston includes a first portion secured with the cover and a second portion secured with the frame, each of the first and second piston portions being rotatable to permit the piston to shift relative to the cover and frame as the cover shifts between the open and closed positions. Additionally, the seal member is operable by the remotely actuated system. Furthermore, the remotely actuated system may include sensors for determining the position of the cover relative to the frame, and sensors for providing information as to operating conditions of the manhole system.

DETAILED DESCRIPTION

Figure 1:
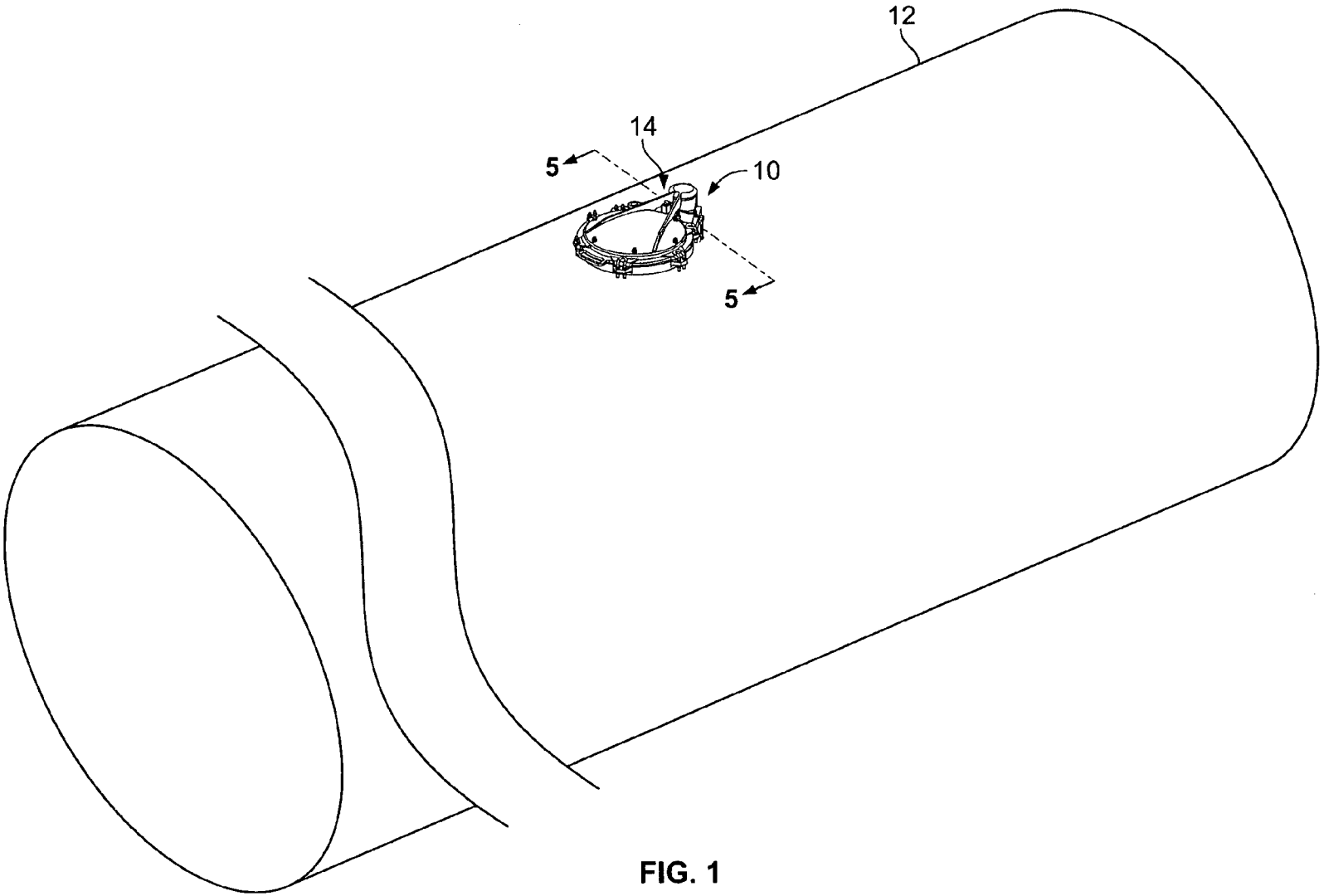
FIG. 1 is a perspective view of a manhole system of the present invention in a closed position and secured with a top surface of a bulk carrier in the form of a tank carrier.
Figure 2:
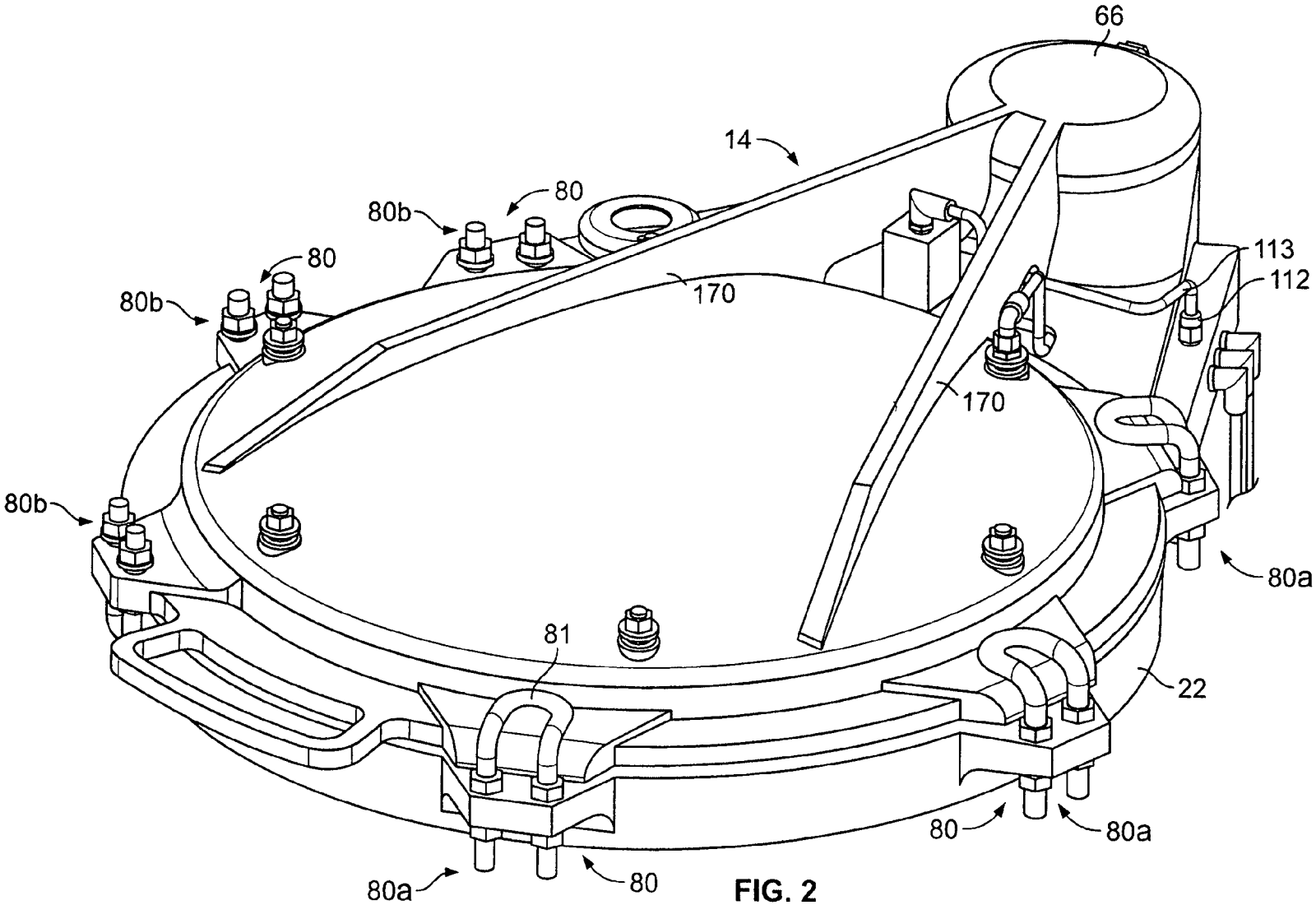
FIG. 2 is an enlarged perspective view of the manhole system of FIG. 1.
Figure 3:
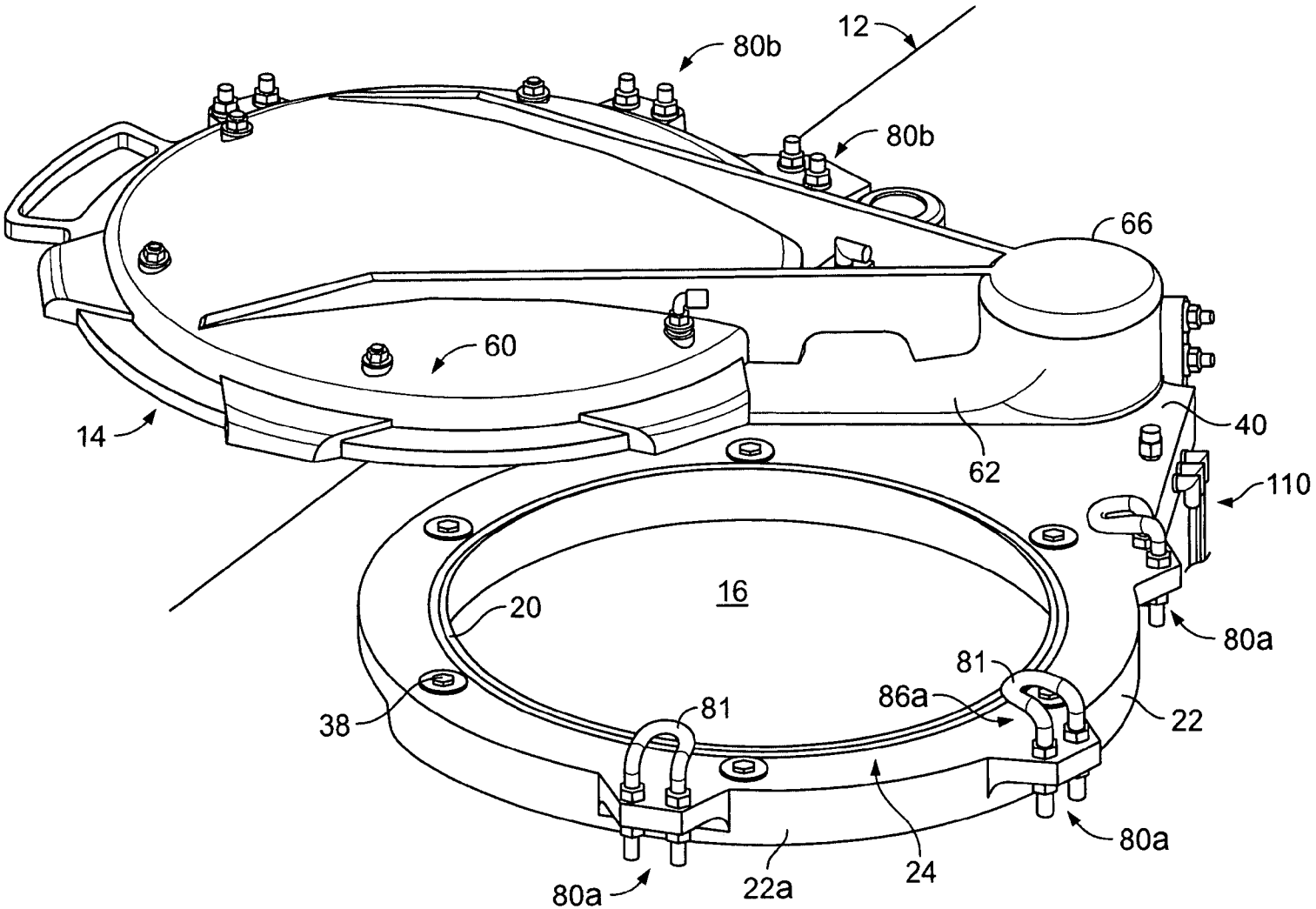
FIG. 3 is an enlarged perspective view of the manhole system of FIG. 1 shifted to an open position.

Referring initially to FIGS. 1-3, a manhole system 10 is shown secured with a bulk carrier 12. The manhole system 10 includes a manhole cover 14 that is selectively shiftable or movable around a pivot axis such that the manhole cover 14 pivots from a closed position, as shown in FIGS. 1 and 2, to an open position, shown in FIG. 3. The bulk carrier 12 includes an opening 16 on its top surface or portion thereof, the opening 16 permitting ingress and egress of a person to the interior of the bulk carrier 12 as well as loading and unloading capabilities through the opening 16 for bulk material (not shown). The opening 16 has a central axis substantially parallel to the pivot axis and is surrounded and defined by a collar 20 (see also FIGS. 4A and 4B). Preferably, the collar 20 is vertically oriented and circular or annular, and it is preferably welded or otherwise integral with the bulk carrier 12.

The manhole system 10 includes a frame 22 for securing with the collar 20. The collar 20 may be part of the manhole system 10, or the collar 20 may be part of the bulk carrier 12 itself. In the latter instance, utilization of such an existing collar 20 allows the manhole system 10 to be retrofitted on a bulk carrier 12 that previously utilized a different system for closing the opening 16.

Figure 4A:
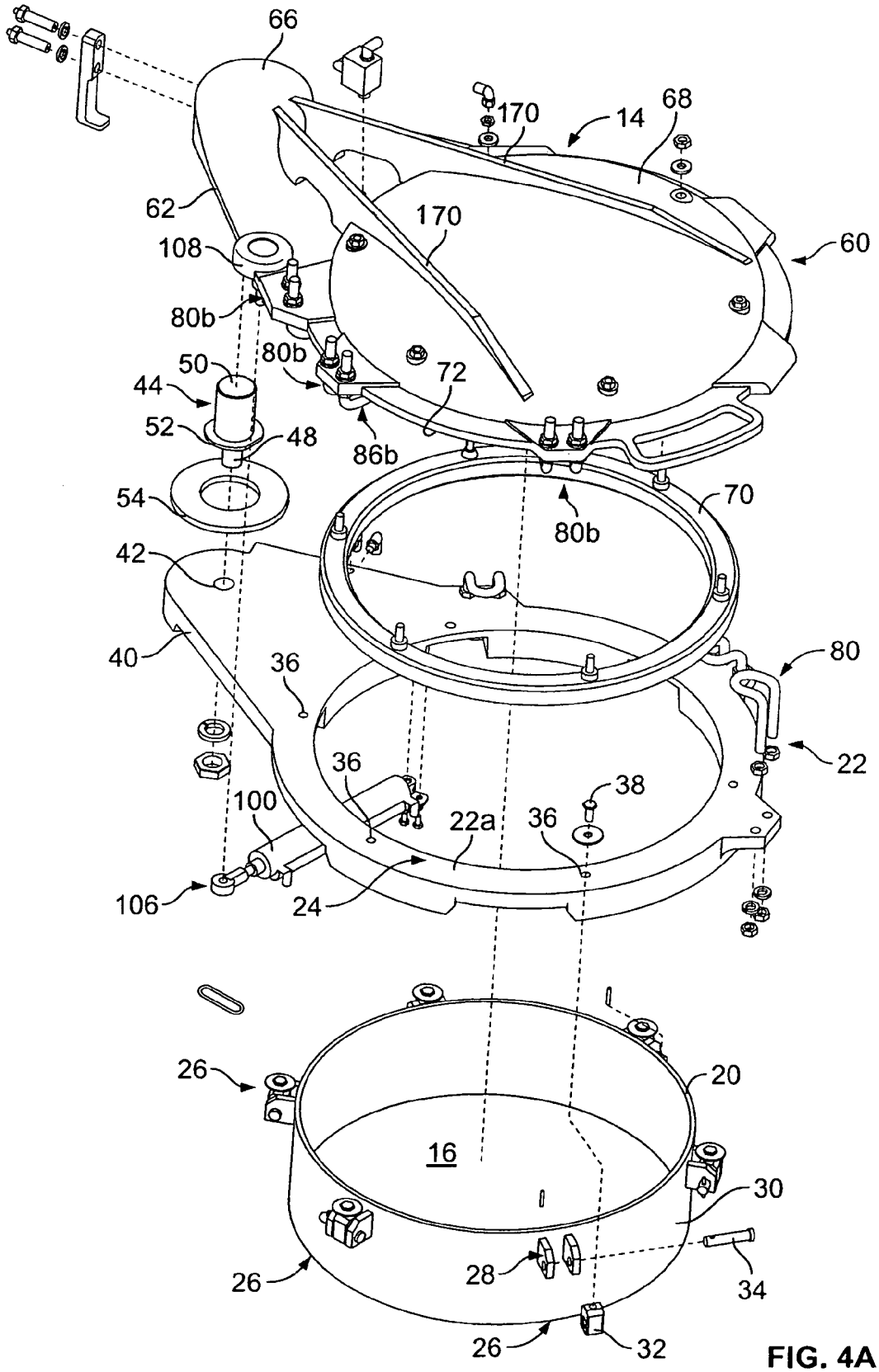
FIGS. 4A and 4B are exploded perspective views of the manhole system.
Figure 4B:
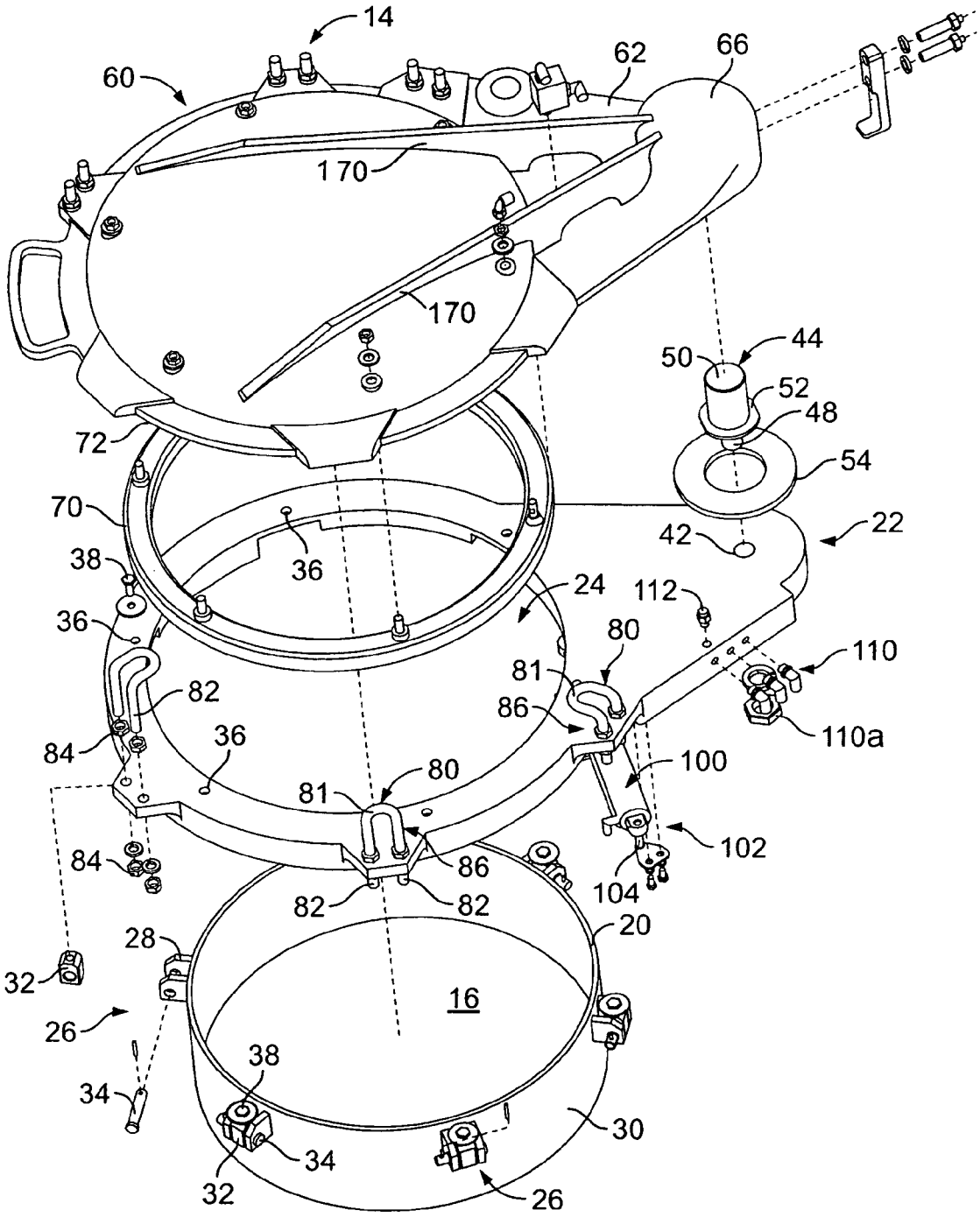
Figure 5:
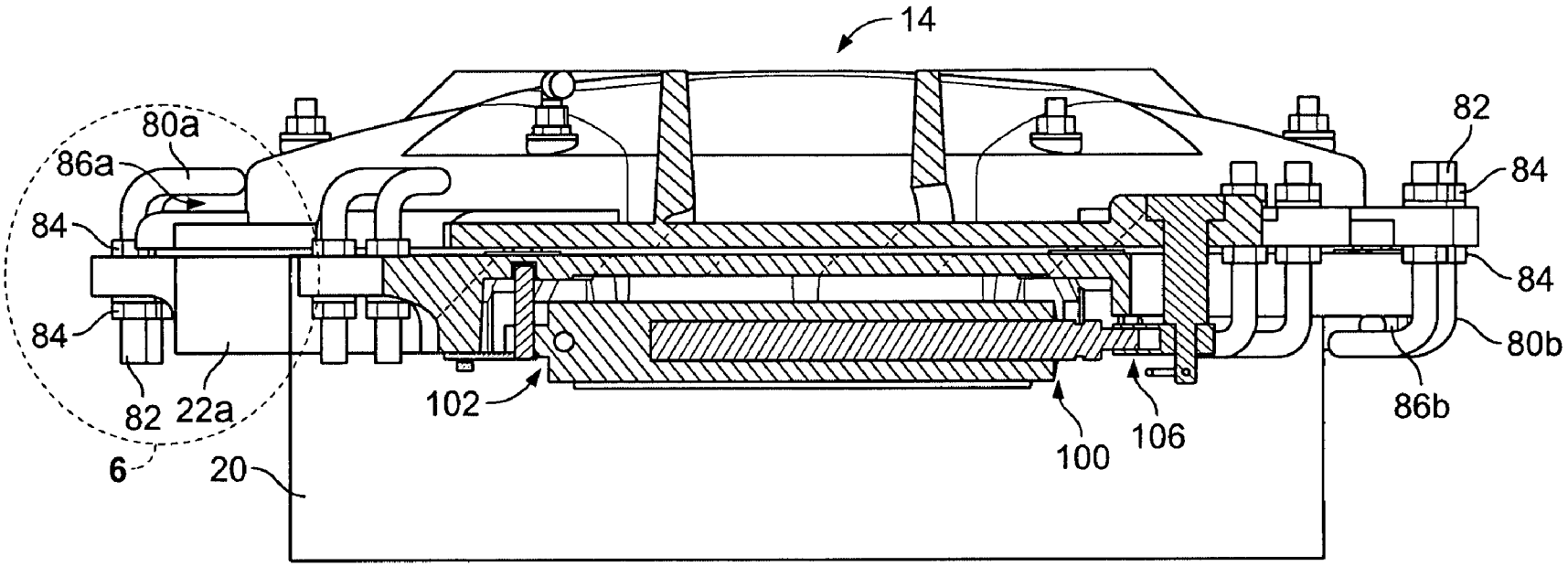
FIG. 5 is a cross-sectional view of the manhole system taken through line 5-5 of FIG. 1 showing the manhole system in a closed position and unlocked position with unengaged catches.
Figure 6:
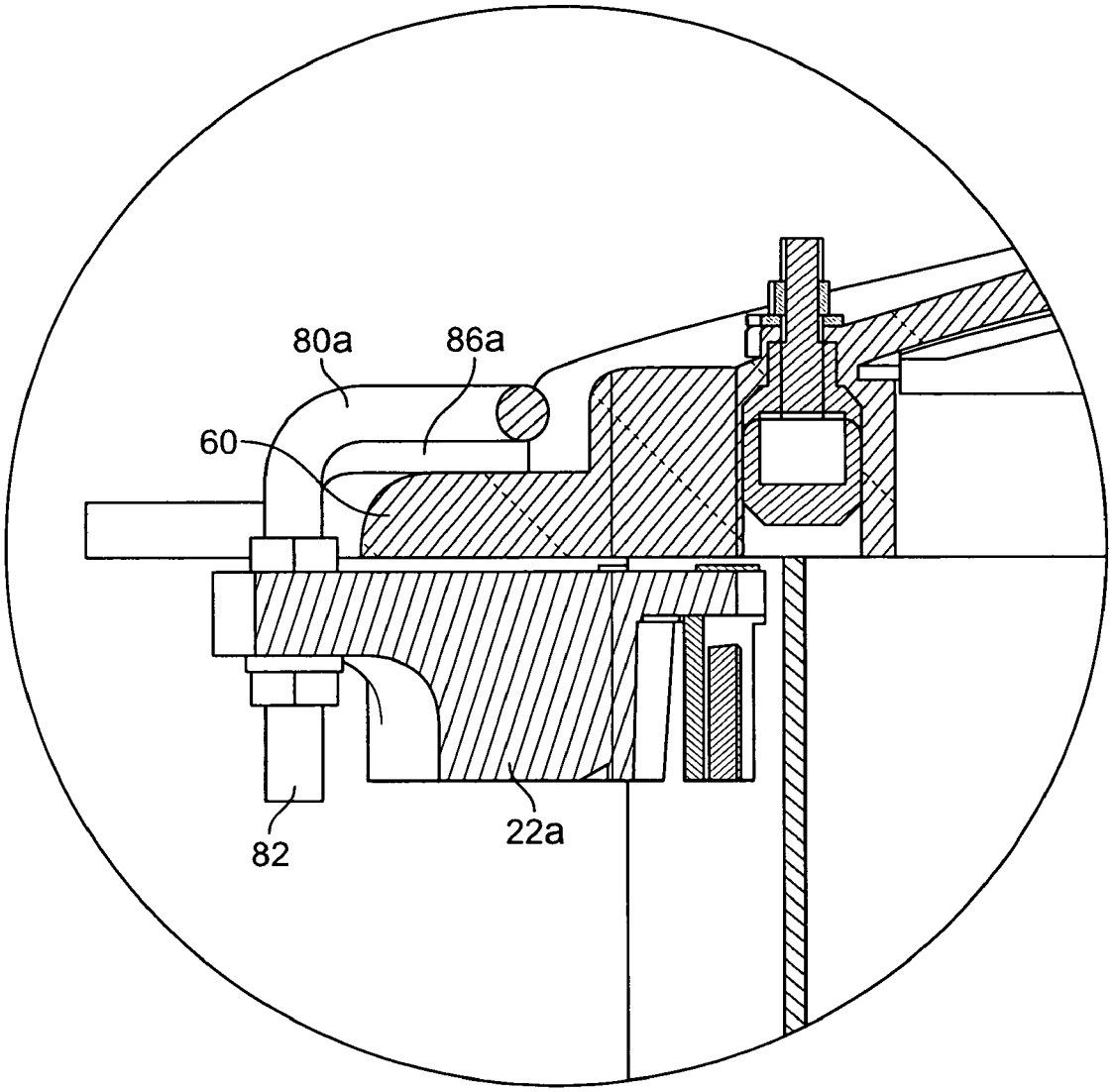
FIG. 6 is an enlarged cross-sectional view of the detail 6 of FIG. 5 showing a stationary catch positioned away from the manhole cover in the unlocked position.
Figure 7:
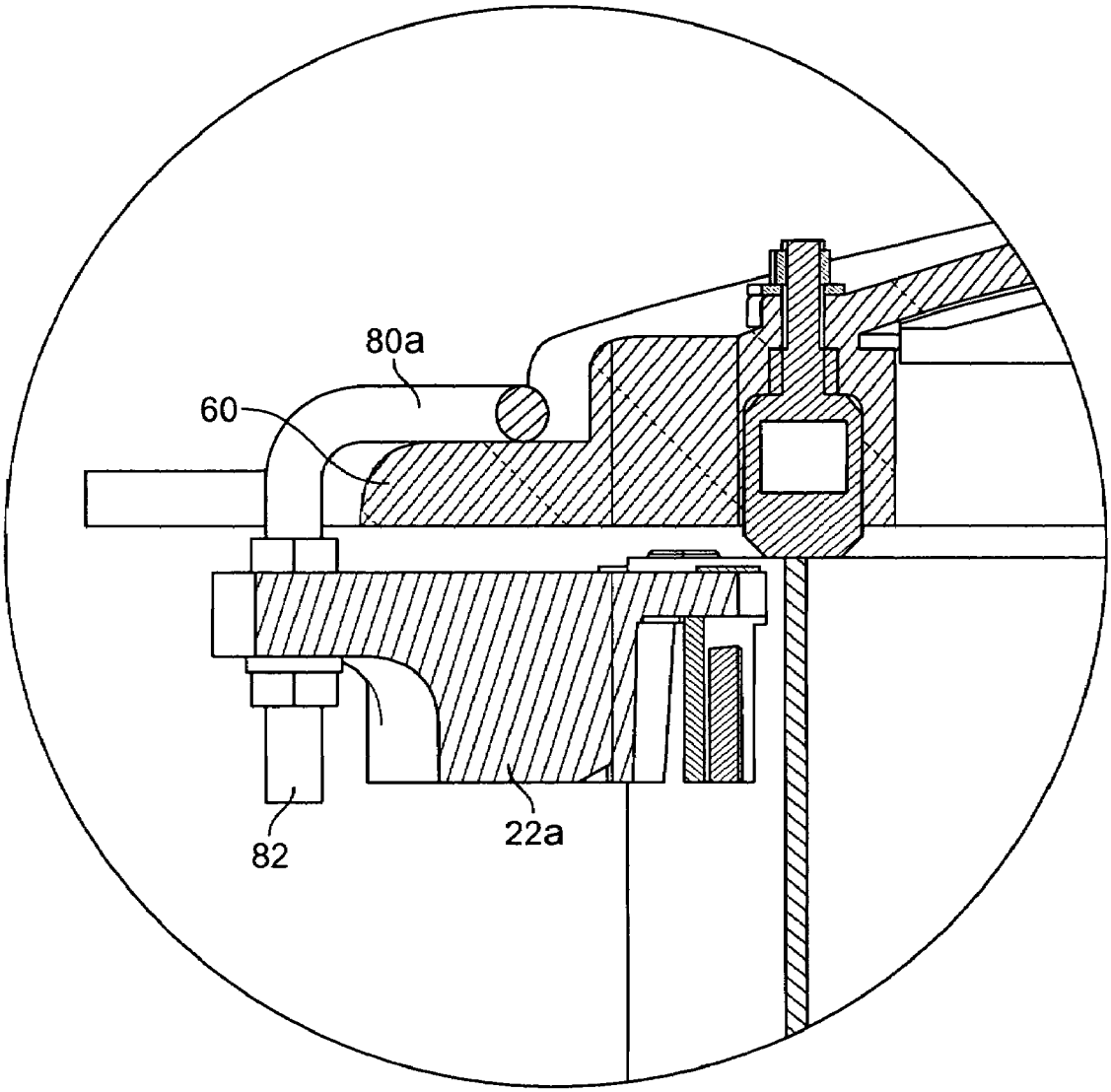
FIG. 7 is an enlarged cross-sectional view similar to FIG. 6 and showing the manhole cover shifted upwardly to a locked position with the catch engaged therewith.

The frame 22 includes a circular cut-out 24 for receiving an upper portion of the collar 20, as can be seen in FIG. 3. The frame 22 may be secured with the collar 20 in a variety of conventional manners as is readily recognized, such as welding the frame 22 and collar 20 together. Preferably, the collar 20 and frame 22 are secured together with a number of securements 26, as best seen in FIGS. 4A and 4B.

In the present form, each securement 26 includes a brace 28 secured with an exterior surface 30 of the collar 20. A pivot nut 32 is positioned within each brace 28 and secured therein by a pin 34. The frame 22 is positioned relative to the collar 20 so that bolt holes 36 provided in a series on the frame 22 are aligned with the pivot nuts 32. A bolt 38 is then inserted through each bolt hole 36 and threadably secured with each pivot nut 32 and brace 28. The arrangement provided by the securements 26 allows the manhole system 10 (other than the collar 20) to be easily removed or replaced, such as when the manhole system 10 becomes damaged, and allows for accurate placement and alignment of the manhole system 10 relative to the bulk carrier 10. With the frame 22 secured to the collar 20, the braces 28 provide support for the manhole system 10 itself.

The frame 22 has a circular portion 22*a* with the described bolt holes 26 and cut-out 24, and has a lower flange 40 extending to one side thereof. The lower flange 40 has a pivot opening 42 vertically aligned for receiving a pivot pin 44 around which the cover 14 rotates or pivots between the open and closed positions. The pivot pin 44 includes a lower portion 48 received within the pivot opening 42, an upper portion 50 received within a recess (not shown) in the cover 14, and a radial flange 52 extending about the pivot pin 44. A washer 54 is positioned around the lower pin portion 48, between the lower flange 40 and the radial flange 52, to support the pivot pin 44 and to provide bearing surfaces between the flanges 40 and 52. As will be described, the pivot pin 44 allows the cover 14 to rotate therearound as well as permits the cover 14 to shift vertically a short distance.

The cover 14 includes a circular portion 60 for covering the opening 16 of the collar 20 in the closed position and an upper flange 62 extending to one side thereof. The upper flange 62 receives the pivot pin 44, as described above. For structural strength, the upper flange 62 includes a pivot bearing 66 that extends upwardly and includes the recess for receiving the pivot pin 44. This allows a greater portion of the pivot pin 44 to be received therein and permits the above-mentioned vertical shifting of the cover 14 relative to the frame 22. For additional support, a top side 68 of the cover 14 includes braces 170 extending from the pivot bearing 66 and upper flange 62 over the circular portion 60.

When in the closed position, the cover 14 and frame 22 are sealed with an inflatable seal 70. As can be seen in FIGS. 4A and 4B, the inflatable seal 70 is carried on a bottom side 72 of the cover 14. The inflatable seal 70 has a first or deflated or contracted configuration and a second or inflated or expanded configuration. Once the cover 14 is in the closed position, the inflatable seal 70 is filled to the inflated configuration to cause pressure between the inflatable seal 70 and the collar exterior surface 30, as well as pressure between the inflatable seal 70 and the bottom side 72 of the cover 14. The weight of the cover 14 is typically sufficient to provide an excellent seal therebetween. It should be noted that the inflatable seal 70 may engage with the collar exterior surface 30, the frame 22, or both.

Inflation of the inflatable seal 70 also provides for engagement of catches 80 provided on the frame 22 and the cover 14 to restrict or prevent pivoting of the cover 14 after the inflatable seal 70 has been inflated and the tank sealed. In prior art systems, inflation of a bladder of the type shown as the inflatable seal 70 places a bending moment or torque on a pivot pin or axis. Over time, this can weaken or worsen the operation of the pivot pin. In any event, the prior art cover and bladder systems did not provide for a vertical shift by a cover to engage catches or hooks. Therefore, the prior art catches or hooks provided only a modicum of resistance to shifting of a cover. In the present manhole system 10, the pivot pin 44 is sized to permit the cover 14 to shift upwardly, relative to the frame and the pivot pin 44, due to the inflation of the inflatable seal 70. This allows for more positive engagement by the catches 80. The catches 80 also serve to assist in defining the closed position for the cover 14 as they prevent over-rotation or rotation beyond the closed position by the cover 14 relative to the frame 22.

More specifically and in the present form, the frame 22 includes three frame catches 80*a* that are stationary while the cover 14 carries three cover catches 80*b* which move along with the cover 14. Each catch 80, as shown, has two threaded foot portions 82 received within holes on either the cover 14 or the frame 22. A pair of nuts 84 are used to precisely position and retain the catch 80 with the cover 14 or the frame 22. The catch 80 is shaped to define a receiving space 86 between it and its supporting structure, either the cover 14 or the frame 22. As can be seen, the frame catches 80*a* extend upwardly from the frame circular portion 22*a* while the cover catches 80*b* extend downwardly from the cover circular portion 60, each to define the receiving space 86. The catches 80 are positioned on their supporting structures so that, when the cover 14 is in the closed position, the frame catches 80*a* receive a portion of the cover 14 in their receiving spaces 86*a* while the cover catches 80*b* receive a portion of the frame 22 in their receiving spaces 86*b*.

With the cover 14 in the closed position and the frame 22 and cover 14 received in the respective receiving spaces of the catches 80, the inflatable seal 70 is then inflated. This first creates the seal between the frame 22 and cover 14 and also lifts the cover 14 upwardly so that the frame catches 80*a* engage with the cover 14 and so that the cover catches 80*b* engage with the frame 22.

The operation of the manhole system 10 is remotely actuated and controlled. To shift the cover 14 between the open and closed positions, a piston 100 is provided which is, for instance, driven by fluid such as by being pneumatically or hydraulically actuated. The piston 100 has a frame end 102 secured with the frame lower flange 40, on a bottom side thereof. The frame end 102 is secured via a bolt 104 that permits the piston 100 to rotate about its frame end as the cover 14 moves. The piston 100 also has a cover end 106 secured with the cover upper flange 62, also via a bolt 108 that permits rotation of the piston thereabout during movement of the cover 14. During operation, the piston 100 is extended to force the cover 14 to rotate around the pivot pin 44 to the open position, or the piston 100 is retracted to rotate the cover 14 to the closed position.

The manhole system 10 includes one or more pressure lines 110 for shifting the cover 14 and for inflating the inflatable seal 70. As can be seen in FIG. 4B, the pressure lines 110 are mounted on the frame lower flange 40 to be in fluid communication with the piston 100. One of the pressure lines 10*a* communicates with a connector 112, which is itself joined by a line 113 (FIG. 2) to the inflatable seal 70. It should be noted that alternative arrangements for the pressure lines 110 may be utilized. Sensors are provided as part of the operating piston 100 so that the operator may be advised as the to exact position of the cover 14 as well as to certain operating conditions, such as an effective seal and proper engagement by the catches 80. Some of these control features are described in U.S. Pat. No. 6,952,996, to Sisk, et al., which is incorporated in its entirety herein by reference. As a result, normal operation of the manhole system 10 obviates the need for an operator to climb aboard the bulk carrier 12, instead remaining on the ground and in more safe position.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A manhole system comprising:

a frame removably securable to an upstanding collar of a bulk carrier structure, the collar defining an opening in the bulk carrier structure, the frame securable around the opening;

a cover movable between an open position substantially away from the opening and a closed position covering the opening;

a seal member providing a seal when the cover is in the closed position, the seal member being expandable and contractable to shift the cover between a locked position and an unlocked position, the seal member being inflatable to a sealed configuration to move the cover to the locked position and deflatable to an unsealed configuration to move the cover to the unlocked position; and a pivot pin supported by the frame and around which the cover rotates, the pivot pin providing a pivot axis, and the pivot pin being sized to permit the cover to shift axially between the locked and unlocked positions, wherein the manhole system is entirely supported by the collar.

2. The manhole system of claim 1 further including catches for restricting movement of the cover beyond the closed position.

3. The manhole system of claim 1 further including catches for restricting movement of the cover beyond in the closed and locked positions.

4. The manhole system of claim 1 wherein the seal member is carried on a bottom side of the cover.

5. The manhole system of claim 1 wherein the opening has a central axis substantially parallel to the pivot axis.

6. The manhole system of claim 1 wherein the seal member shifts from the unsealed configuration to the sealed configuration to move the cover to the locked position, and the seal member shifts from the sealed configuration to the unsealed configuration to permit the cover to gravitationally shift from the locked position to the unlocked position.

7. The manhole system of claim 1 further comprising a remotely controllable drive mechanism for moving the cover between the open and closed positions.

8. The manhole system of claim 1 further comprising a powered drive mechanism for moving the cover between the open and closed positions.

9. The manhole system of claim 8 wherein the powered drive mechanism includes a piston.

10. The manhole system of claim 9 wherein the piston is retractable to move the cover to the closed position, and the piston is extendable to move the cover to the open position.

11. The manhole system of claim 10 wherein the piston includes a first portion secured with the cover and a second portion secured with the frame, each of the first and second piston portions being pivotable to permit the piston to shift relative to the cover and the frame as the cover shifts between the open and closed positions.

12. The manhole system of claim 10 wherein piston is driven by fluid pressure.

13. The manhole system of claim 1 further comprising a remotely controllable system for moving the cover and expanding and contracting the seal member.

14. The manhole system of claim 13 wherein the remotely controllable system includes sensors for determining the position of the cover relative to the frame.

15. The manhole system of claim 13 wherein the remotely controllable system includes sensors for providing information as to operating conditions of the manhole system.

16. The manhole system of claim 1 wherein the seal member is located between the cover and the bulk carrier structure.

17. The manhole system of claim 1 wherein the seal member is located between the cover and the frame.

* * * * *